US007306100B1

(12) United States Patent
Eslambolchi et al.

(10) Patent No.: US 7,306,100 B1
(45) Date of Patent: Dec. 11, 2007

(54) PROTECTIVE COVER FOR FIBER CABLE REELS AND METHOD FOR PROTECTING SAME

(76) Inventors: Hossein Eslambolchi, 13826 Moon La., Los Altos Hills, Santa Clara County, CA (US) 94022; John Sinclair Huffman, 261 Cowan Rd., Conyers, Rockdale County, GA (US) 30094

( * ) Notice: Subject to any disclaimer, the term of this patent is extended or adjusted under 35 U.S.C. 154(b) by 442 days.

(21) Appl. No.: 10/743,528

(22) Filed: Dec. 22, 2003

(51) Int. Cl.
*B65D 85/66* (2006.01)

(52) U.S. Cl. ..... 206/398

(58) Field of Classification Search ..... 206/398, 206/399, 400, 410, 820
See application file for complete search history.

(56) References Cited

U.S. PATENT DOCUMENTS 3,749,233 A * 7/1973 McCormick, Jr. ..... 206/373
3,941,246 A * 3/1976 Duden ..... 206/455
4,029,206 A * 6/1977 Mykleby ..... 206/400
D276,004 S * 10/1984 Mink ..... D3/299
4,621,486 A * 11/1986 Slavicek ..... 53/580
4,790,475 A * 12/1988 Griffin ..... 229/69
D299,620 S * 1/1989 Kim ..... D9/717
4,852,737 A * 8/1989 Noll ..... 206/714
4,901,464 A * 2/1990 Banoun ..... 42/95
D323,065 S * 1/1992 Stricklin et al. ..... D3/206
5,165,543 A * 11/1992 Heyda et al. ..... 206/400
5,427,239 A * 6/1995 Hunt ..... 206/372
6,298,626 B2 * 10/2001 Rudden ..... 52/520
6,409,017 B1 * 6/2002 Bookbinder et al. ..... 206/398
D471,011 S * 3/2003 Kowalsky ..... D3/299
6,935,502 B1 * 8/2005 Stoll et al. ..... 206/400

OTHER PUBLICATIONS

Science Daily, May 18, 2001.*
Dow Ethafoam 220 fact sheet.*

* cited by examiner

*Primary Examiner*—Mickey Yu
*Assistant Examiner*—Jerrold Johnson

(57) ABSTRACT

The present invention is an apparatus and method for protecting an optical fiber cable stored on a fiber cable reel. A wrapping member is placed around the circumference of the fiber cable in the reel. The wrapping member includes insulating members that may be bonded to the wrapping member or installed in pockets of the wrapping member. The insulating members may be ceramic blocks.

16 Claims, 3 Drawing Sheets

PROTECTIVE COVER FOR FIBER CABLE REELS AND METHOD FOR PROTECTING SAME

FIELD OF THE INVENTION

The present invention relates generally to the use of fiber cable reels in the installation of fiber routes in telecommunications fiber optic cable networks. More particularly, the present invention is an apparatus and method for protecting stored fiber cable reels from the elements.

BACKGROUND OF THE INVENTION

Fiber cables are shipped to various storage yards around the country as new fiber routes are installed. Those reels often must stand out in the open air for years before they are used by the installation crews. In addition, spare restoration reels are stored out in the open air as well. Those reels are placed around the country and are used in the event of a cable failure.

Fiber cable reels will typically have up to 40,000 feet of fiber (up to 800 fiber count). Each reel of cable therefore represents a substantial investment by the utility company owning the cable stock.

The reels are most commonly constructed of wood, although plastic and steel reels are known. The reels have flanges on each end protruding from a central spool. An arbor hole extends through the spool along its axis. The fiber cable is wrapped on the spool between the flanges in an even manner, so the diameter of the outside circumferential surface of the fiber cable is substantially constant between the flanges.

The stored reels are often subjected to very high temperatures (120 degrees F.) and to very low temperatures (−20 to −30 degrees F.). That harsh environment may degrade the transmission performance and longevity of the fiber cable, and may even destroy the cable. Spare fiber reels are therefore sometimes stored under cover of buildings to protect the fiber from those extremes of temperature, resulting in substantial additional costs. Often, such storage is not available, especially during the installation of fiber routes.

Optical fiber cable manufacturers will sometimes ship the fiber cable with a plastic or cardboard cover. That cover does not stand up to harsh weather and high temperatures, and generally does little to protect the fiber cable from the effects of temperature.

There is therefore presently a need for device and a method for protecting bulk fiber cable stored on reels. The device should preferably be reusable, and should stand up to outdoor conditions as well as protect the fiber optic cable from outdoor temperature extremes. To the inventors' knowledge, there is currently no such apparatus or method currently employed to satisfactorily accomplish that task.

SUMMARY OF THE INVENTION

The present invention addresses the needs described above by providing, in one embodiment, a protective cover for optical fiber cable stored on a fiber cable reel. The protective cover includes an elongate flexible wrapping member having a length sufficient to extend substantially around an outer circumference of the optical fiber cable. A plurality of insulating members are disposed along the wrapping member. The insulating members being arranged in proximity to each other to form an insulating region. A fastening member is arranged for fastening the wrapping member around the outer circumference of the optical fiber cable.

The flexible wrapping member may be constructed of fabric, and the fabric may be nylon. The wrapping member may include a plurality of pockets, in which case the insulating members are disposed within the pockets. The long sides of the pockets may overlap long sides of adjacent pockets; alternatively, the long sides of the pockets may substantially abut long sides of adjacent pockets.

The insulating members may be elongate in shape and have a length substantially perpendicular to the length of the wrapping member. The insulating members may be bonded to the wrapping member. The insulating members may be ceramic blocks.

The wrapping member may have a width sufficiently narrow to be placed between flanges of the fiber cable reel. Alternatively, the wrapping member may be wide enough to be placed over the flanges.

The insulating members may be removable from the wrapping member. The fastening member may be a cinch strap attached to the wrapping member and extending the length of the wrapping member.

In another embodiment of the invention, a method is provided for protecting an optical fiber cable stored on a fiber cable reel. The method includes the step of wrapping a protective cover around an outer circumference of the optical fiber cable. The protective cover includes an elongate wrapping member having a plurality of pockets containing ceramic insulating members. The method also includes the step of fastening the protective cover around the circumference of the optical fiber cable.

The step of wrapping the protective cover around an outer circumference of the cable may include placing the cover between flanges of the fiber cable reel, or may alternatively include placing the cover over circumferences of flanges of the fiber cable reel. The step of fastening the protective cover around the circumference of the optical fiber cable may include cinching at least one strap around the cover.

The pockets may be elongate in shape and have a length substantially perpendicular to the length of the wrapping member. The pockets may overlap.

DESCRIPTION OF THE INVENTION

Figure 1:
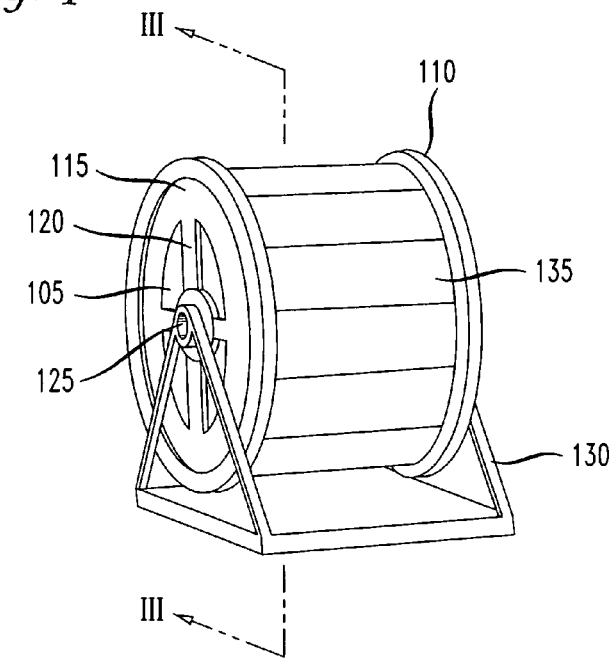
FIG. 1 is a view of an fiber optical cable reel with a protective cover according to one embodiment of the invention.

An apparatus protecting fiber optic cable stored on a reel according to the present invention is shown in FIG. 1. A cable storage reel 110 includes supports 120 radiating from a central hub. An arbor hole 125 extends through the central hub and accepts an arbor with arbor supports 130 for storage and for spooling cable. Flanges 115 extend radially outward from a spool 105 at both ends of the spool. Fiber cable (not shown) is wrapped on the spool 105 between the flanges 115.

A protective shroud or cover 135 is installed over the fiber cable to prevent high and low temperatures from directly striking the fiber cable. The protective shroud 135 covers the area of the fiber cable that is exposed to ambient conditions. That area is the outer circumference of the fiber cable as it is wrapped on the cable reel.

Figure 2:
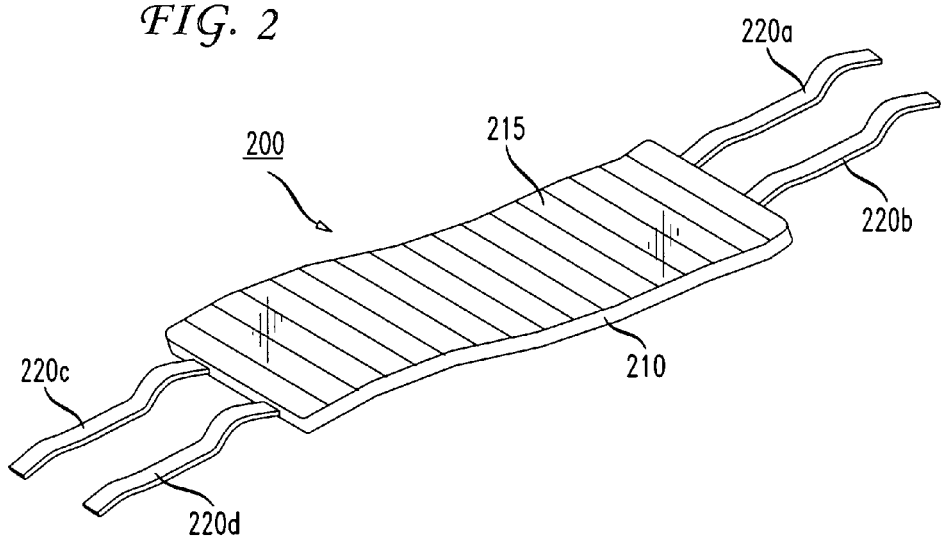
FIG. 2 is a view of the protective cover of FIG. 1 in an uninstalled condition.

A protective cover 200 is shown in an uninstalled condition in FIG. 2. The cover 200 includes a weather resistant wrapping member 210 that can be draped around the fiber reel. The wrapping member is elongate in shape, and has a plurality of insulating members 215 disposed along the wrapping member 210. The insulating members 215 are preferably elongate and have a long axis that is perpendicular to the long axis of the wrapping member. The wrapping member is flexible, and may be composed of a woven or non-woven fabric material or another flexible sheet material such as Mylar® film. In a preferred embodiment, a heavy gauge nylon fabric is used.

Fastening members 220*a*-220*d* extend from the ends of the wrapping member for attaching the wrapping to the fiber cable or reel. The fastening members may be a webbing material such as nylon strapping, having ratcheting strapping clamps or other tie-down devices known in the art. Alternatively, steel strapping may be used. The fastening members 220*a*-220*d* may be attached individually at each end of the wrapping member, as shown in FIG. 2, in which case the wrapping member is put in tension as the fastening members are tightened. Alternatively, the fastening members may extend completely around the circumference of the wrapping member and compress the wrapping member and insulating members radially inward when tightened.

In a preferred embodiment, the insulating members 215 are ceramic tiles that are placed along the wrapping member 210. The tiles serve as a protector of the fiber cable, and will not allow direct sunlight strike the fiber cable. The high temperatures that are normally present when a reel is stored out in the open are not allowed to transfer to the fiber cable underneath the ceramic tiles and wrapping member. Similarly, cold temperatures also are not transferred to the fiber cable. The ceramic tiles used in the preferred embodiment are similar to those used throughout the aerospace industry to protect space craft from high/low temperatures. The ceramic tiles comprise clay, flint and/or feldspar molded and fired into a block of material that resists the transfer of heat or cold to material underneath it.

The insulating members 215 may be attached to the wrapping member in any appropriate manner. For example, the insulating members may be bonded to the wrapping member 210 using a suitable adhesive. In a currently preferred embodiment, the insulating members 215 are inserted in pockets provided for that purpose in the wrapping member. The pockets may then be permanently closed, for example, by stitching or bonding, or the insulating members may be made removable for repair or replacement. In that case, the pockets may have folding covers, or may be closeable by zipper or hook-and-loop closure.

Figure 3A:
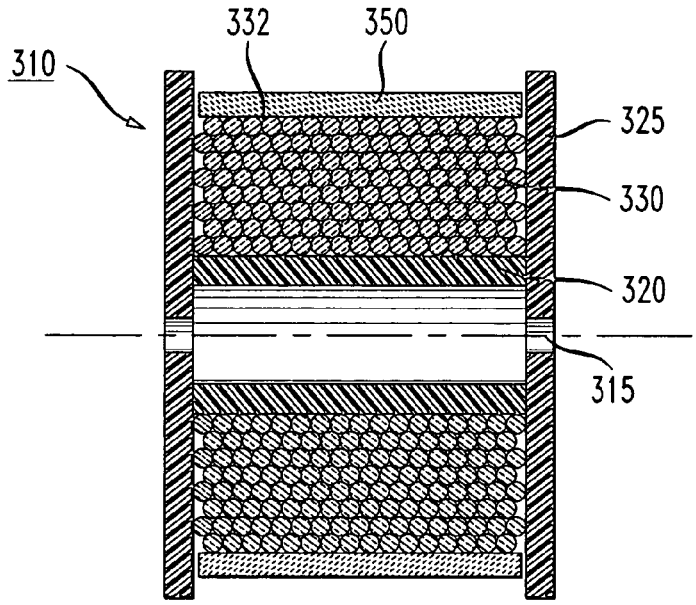
FIGS. 3*a* and 3*b* are sectional views of the reel and protective cover of FIG. 1 through section III-III, according to two different embodiments of the invention.

A sectional view through a fiber cable reel 310 having a protective cover 350 is shown in FIG. 3*a* to illustrate one embodiment of the invention. A coil of fiber optic cable 330 has been wrapped on a spool 320 between flanges 325. The reel may be mounted on an arbor (not shown) placed through a central arbor hole 315.

The protective cover 350 of the invention is placed directly over the outer circumferential surface 332 of the coil of fiber cable 330. Because the outer surface 332 of the spooled fiber cable is radially inside the outer edge of the flanges 325, the protective cover 350 of the invention must have a width small enough to fit between the flanges 325 in order to be placed directly over the fiber cable. Such an arrangement is advantageous because the flange outer edges are free for rolling on the ground without harming the protective cover.

Figure 3B:
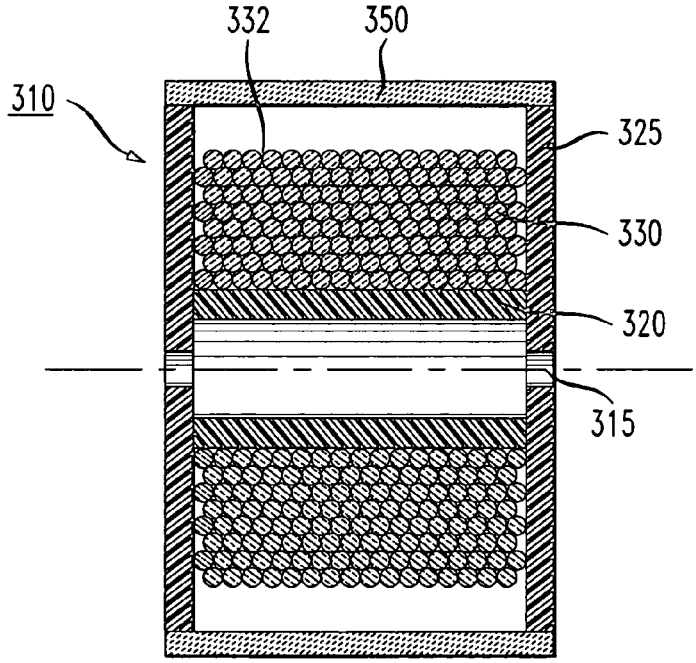

Another embodiment of the invention is shown in FIG. 3*b*, in which like elements have like numbering as in FIG. 3*a*. The protective cover 360 of FIG. 3*b* extends over the outer edge of the flanges 325 and rests on those outer edges. The width of the cover 360 must therefore be sufficiently long to span the flanges 325. Such an arrangement is advantageous in that the cover 360 may be provided with special interfacing structure (not shown) for attaching to the outer edge of the flange, such as a tongue and groove arrangement. Further, there is no minimum clearance required for the protector between the outer circumferential surface 332 of the cable coil and the outer edge of the flange 325.

Figure 4:
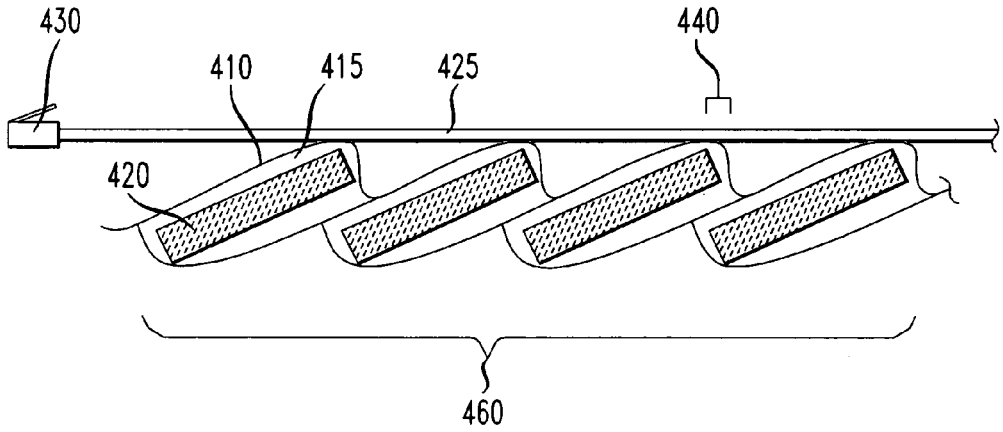
FIG. 4 is a sectional view of the protective cover of the invention in an uninstalled condition, according to one embodiment of the invention.

An arrangement of a wrapping member 410 having pockets 415 for the insulating members 420 is shown in sectional view in FIG. 4. In that embodiment of the invention, the insulating members 420 overlap by a distance 440 due to the particular arrangement of the pockets in the wrapping member. The insulating members 420 form an insulating region 460. By permitting the insulating members to overlap, the insulating region 460 has little or no area between the insulating members for extreme ambient heat to be conducted in to the fiber cable, or for heat to be conducted out under extreme cold conditions.

A continuous fastening member 425 and cinching buckle 430 are provided to attach the protective cover around the fiber optic cable. In the presently described embodiment, care must be taken in choosing a material and material thickness for the wrapping member 410 in order to protect the insulating members 420 from adjacent insulating members at the overlap points.

Figure 5:
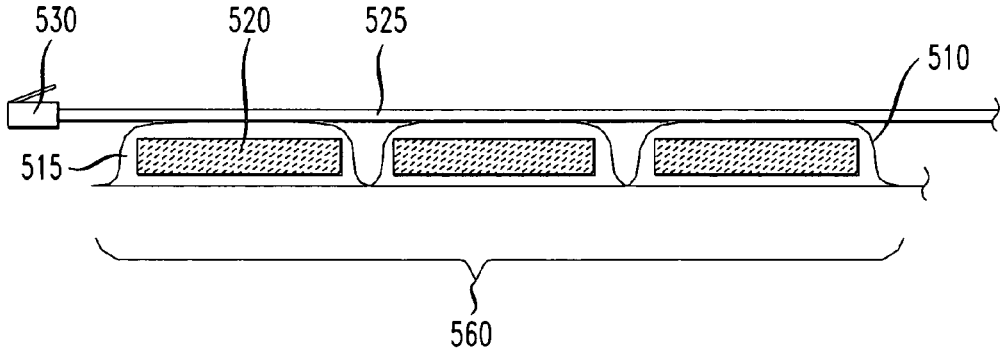
FIG. 5 is a sectional view of the protective cover of the invention in an uninstalled condition, according to another embodiment of the invention.

An embodiment of the invention having a side-by-side arrangement of insulating members is shown in FIG. 5. The wrapping member 510 has non-overlapping pockets 515 for the insulating members 520. The insulating members 520 form an insulating region 560. In that embodiment, the insulating members are allowed to lie "flat" against the cable coil, reducing stress on the insulating members when the fastening member 525 is tightened with the cinching buckle 530.

The foregoing Detailed Description is to be understood as being in every respect illustrative and exemplary, but not restrictive, and the scope of the invention disclosed herein is not to be determined from the Detailed Description, but rather from the claims as interpreted according to the full breadth permitted by the patent laws. For example, while the system is described primarily in connection with the protection of optical fiber cables, the method and apparatus of the invention may also be used to protect other delicate conveyances that are stored on reels, such as underwater cable, etc. It is to be understood that the embodiments shown and described herein are only illustrative of the principles of the present invention and that various modifications may be implemented by those skilled in the art without departing from the scope and spirit of the invention.

What is claimed is:

1. A protective cover for an optical fiber cable coil stored on a fiber cable reel, comprising:

an elongate flexible wrapping member having a length sufficient to extend substantially around an outer circumferential surface of the optical fiber cable coil;

a plurality of insulating members disposed on the wrapping member, said insulating members being arranged in proximity to each other to form an insulating region; and a fastening member arranged for fastening the wrapping member around the outer circumferential surface of the optical fiber cable coil;

wherein:

said wrapping member includes a plurality of pockets, and said insulating members are disposed within said pockets; and each of the pockets overlaps another pocket that is adjacent along the wrapping member, and each of the insulating members disposed in those pockets overlaps another insulating member.

2. The protective cover of claim 1, wherein the flexible wrapping member is constructed of fabric.

3. The protective cover of claim 2, wherein the fabric is nylon.

4. The protective cover of claim 1, wherein long sides of the pockets substantially abut long sides of adjacent pockets.

5. The protective cover of claim 1, wherein the insulating members are elongate in shape and have a length substantially perpendicular to the length of the wrapping member.

6. The protective cover of claim 1, wherein said insulating members are bonded to said wrapping member.

7. The protective cover of claim 1, wherein the insulating members are ceramic blocks.

8. The protective cover of claim 1, wherein the wrapping member has a width sufficiently narrow to be placed between flanges of the fiber cable reel.

9. The protective cover of claim 1, wherein the wrapping member has a width sufficiently wide to be placed over flanges of the fiber cable reel.

10. The protective cover of claim 1, wherein the insulating members are removable from the wrapping member.

11. The protective cover of claim 1, wherein the fastening member is a cinch strap attached to the wrapping member and extending the length of the wrapping member.

12. A method for protecting an optical fiber cable coil stored on a fiber cable reel, comprising the steps of:

providing an elongate flexible wrapping member having a length sufficient to extend substantially around an outer circumferential surface of the optical fiber cable coil;

providing a plurality of insulating members disposed on the wrapping member, said insulating members being arranged in proximity to each other to form an insulating region;

providing a fastening member arranged for fastening the wrapping member around the outer circumferential surface of the optical fiber cable coil;

wherein:

said wrapping member includes a plurality of pockets, and said insulating members are disposed within said pockets; and each of the pockets overlaps another pocket that is adjacent along the wrapping member, and each of the insulating members disposed in those pockets overlaps another insulating member;

wrapping the protective cover around an outer circumferential surface of the optical fiber cable coil; and fastening the protective cover around the outer circumferential surface of the optical fiber cable coil.

13. The method of claim 12, wherein the step of wrapping the protective cover around an outer circumferential surface of the cable includes placing the cover between flanges of the fiber cable reel.

14. The method of claim 12, wherein the step of wrapping the protective cover around an outer circumferential surface of the cable includes placing the cover over circumferences of flanges of the fiber cable reel.

15. The method of claim 12, wherein the step of fastening the protective cover around the outer surface of the optical fiber cable coil includes cinching at least one strap around the cover.

16. The method of claim 12, wherein the pockets are elongate in shape and have a length substantially perpendicular to the length of the wrapping member.

* * * * *